US010464747B2

(12) United States Patent
Abang, Jr.

(10) Patent No.: US 10,464,747 B2
(45) Date of Patent: Nov. 5, 2019

(54) BIN

(71) Applicant: Robert Owan Abang, Jr., Tampa, FL (US)

(72) Inventor: Robert Owan Abang, Jr., Tampa, FL (US)

(73) Assignee: Robert Owan Abang, Jr., Tampa, FL (US)

( * ) Notice: Subject to any disclaimer, the term of this patent is extended or adjusted under 35 U.S.C. 154(b) by 0 days.

(21) Appl. No.: 15/957,236

(22) Filed: Apr. 19, 2018

(65) Prior Publication Data

US 2018/0265286 A1 Sep. 20, 2018

Related U.S. Application Data

(63) Continuation-in-part of application No. 15/461,775, filed on Mar. 17, 2017.

(51) Int. Cl.

| | |
|---|---|
| ***B65F 1/08*** | (2006.01) |
| ***B65F 1/14*** | (2006.01) |
| ***B65F 1/16*** | (2006.01) |
| ***B65F 1/06*** | (2006.01) |

(52) U.S. Cl.

CPC ..... *B65F 1/1415* (2013.01); *B65F 1/06* (2013.01); *B65F 1/163* (2013.01)

(58) Field of Classification Search

CPC .... B65F 1/06; B65F 1/08; B65F 1/085; B65F 1/141; B65F 1/1415; B65F 1/1436; B65F 1/1452; B65F 1/1457; B65F 1/163; B65F 2210/18

USPC ..... 211/195, 200–202; 220/495.06, 495.08, 220/495.11, 628, 629, 908.1; 108/116–118, 120, 144.11, 145, 147

See application file for complete search history.

(56) References Cited

U.S. PATENT DOCUMENTS

| | | | | | |
|---|---|---|---|---|---|
| 269,625 | A | * | 12/1882 | Blake | B65F 1/1415 248/98 |
| 3,356,183 | A | * | 12/1967 | Shell | B65F 1/1457 312/272.5 |
| 3,494,503 | A | * | 2/1970 | Kingsley | B65G 1/07 312/306 |
| 5,031,796 | A | * | 7/1991 | Schafer | B65F 1/14 220/371 |

(Continued)

FOREIGN PATENT DOCUMENTS

| | | | | |
|---|---|---|---|---|
| CN | 104291044 | * | 1/2015 | |
| CN | 106809560 | * | 6/2017 | |
| ES | 2192425 A1 | * | 10/2003 | B65F 1/1457 |

*Primary Examiner* — Joshua E Rodden

(57) ABSTRACT

The current invention relates to a bin used in combination with a liner for various purposes, including but not limited to the disposal of trash and the collection of recycled material. The bin having an exterior surface, an interior surface, a body, a closed bottom end, an open top end, and an interior chamber. The bin including at least a slideable top portion allowing for the top opening of the bin to be adjusted in periphery thereby enabling liners of various sizes to be secured in the interior chamber of the bin. In addition, a bin including an adjustable bin lid member within a bin lid enabling liners of various sizes to be secured in the interior chamber of the bin. Furthermore, a bin including a vertical moving floor plate within the interior chamber of the bin for supporting liners of various lengths.

11 Claims, 5 Drawing Sheets

(56) References Cited

U.S. PATENT DOCUMENTS

| | | | | |
|---|---|---|---|---|
| 6,102,343 | A * | 8/2000 | Grimesey | B65F 1/06 220/908 |
| 7,090,092 | B1 * | 8/2006 | Roebuck, Jr. | D06F 95/002 220/629 |
| 7,849,789 | B1 * | 12/2010 | Whelan | A47J 47/005 108/116 |
| 8,210,380 | B2 * | 7/2012 | Jin | B65F 1/02 206/761 |
| 8,984,847 | B1 * | 3/2015 | Nguyen | B65F 1/062 220/908.1 |
| 9,701,469 | B1 * | 7/2017 | Reith | B65F 1/062 |
| 9,745,116 | B1 * | 8/2017 | Lopez | D06F 95/002 |
| 2009/0071964 | A1 * | 3/2009 | Phipps | B65F 1/06 220/495.08 |
| 2009/0218341 | A1 * | 9/2009 | Wu | B65F 1/06 220/4.28 |
| 2011/0156903 | A1 * | 6/2011 | Henniges | B62B 3/106 340/540 |
| 2011/0272407 | A1 * | 11/2011 | Golcheh | B65F 1/12 220/495.06 |
| 2012/0055933 | A1 * | 3/2012 | Jones | B65F 1/068 220/495.06 |
| 2013/0105486 | A1 * | 5/2013 | Mashburn | B65F 1/06 220/495.06 |
| 2016/0249737 | A1 * | 9/2016 | Han | A47B 9/02 108/145 |

* cited by examiner

BIN

CROSS REFERENCE TO RELATED APPLICATION

This application is a continuation in part of U.S. Utility patent application Ser. No. 15/461,775 filed Mar. 17, 2017 and incorporated in its entirety herein by reference.

DESCRIPTION

Technical Field of the Invention

The present invention relates to bins which are commonly used in combination with a liner in a variety of applications, particularly but not limited to the disposal of trash and the collection of recycled material. These bins come in various shapes and sizes, and are usually made of forms of metal, plastic, aluminum, steel, a combination of and/or other suitable material.

BACKGROUND OF THE INVENTION

For years disposable bags used for bagging groceries, shopping and more are commonly being re-used in combination with bins as liners. These liners are inserted into the bin and later removed from the bin and used to carry the accumulated contents to dispose of or recycle into a larger container or at a location for disposal (e.g. into a dumpster or at the curb for pickup by a trash/recycling collection service). Majority of these liners however cannot be inserted into standard size bins because the liners are too small and therefore the top opening of the liner is unable to go around the top portion of the bin. Some other liners are wide enough to be inserted into a bin but these liners however after being inserted into the bin most times fall into the bin after trash or other material have been thrown in them because they are too short to reach the floor of the bin. Therefore, these liners don't function properly because they are either too small to go around the top portion of the bin or too short to reach the floor of the bin. Due to this, a lot of consumers instead of making a second productive use out of these liners end up just disposing of them too quickly. There is therefore a need for an improved bin capable of accommodating liners of all sizes. Current bins available today do not address this need.

DESCRIPTION OF THE PRIOR ART

Bins for disposal of trash and collection of recycled material typically involve the use of a liner. These liners come in various sizes to be inserted into the interior chamber of the bin. Most bins also come with bin lids, which are utilized as just a cover for the bins for covering the contents disposed within the interior chamber of the bin. However due to the rigid structure of the bin and bin lids, liners of different sizes cannot all fit in the interior chamber of the bin because the top opening of the liner is unable to go around the top portion of the bin, and therefore cannot be effectively used as a liner:

U.S. Pat. No. 7,624,915 issued to Dembowiak et al describes a recycling center having a receiving chamber. A bag support having a first rail, second rail, and support bar is slidably mounted to the walls of the receiving chamber. The bag support is movable between a first position wherein the bag support is within the receiving chamber, and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,042,703 issued to Dembowiak describes a recycling center having a receiving chamber. A bag slide comprising of a first rail, second rail, at least a rod extending between the first and second rails, and pivotable bag retainers slidably mounted to the walls of the receiving chamber. The bag slide is movable between a first position wherein the bag support is within the receiving chamber and a second position wherein the bag support is at least partially outside the receiving chamber. The invention does not relate to a bin with the ability to extend and retract the top upper portion of the bin, or an adjustable bin lid for liners of different sizes to fit in the interior chamber of the bin.

U.S. Pat. No. 8,302,916 issued to Dembowiak et al describes a bag support comprising of a first bar, second bar, at least a support extending between first and second bar, and pivotable bag retainers extending from the bar to support a bag. The bag retainers pivotable between a first position and a second bag retaining position. The invention does not relate to a bin with the ability to extend and retract the top upper portion of the bin, or an adjustable bin lid for liners of different sizes to fit in the interior chamber of the bin.

U.S. Pat. No. 5,803,299 issued to Sealy Jr describes a bag support insert with telescoping members mounted on the upper edges of a container with bag support pegs for supporting a trash bag. This invention is not part of the container and does not relate to a bin with the ability to extend and retract the top upper portion of the bin, or an adjustable bin lid for liners of different sizes to fit in the interior chamber of the bin.

U.S. Patent Application No. 20070062953 issued to Lin describes a trashcan with at least a cover comprised of two parallel sliding portions having a rail and a track to open and close the trashcan. The purpose of this invention is to cover the contents disposed within the bin interior chamber and does not relate to a bin with the ability to extend and retract the top upper portion of the bin, or an adjustable bin lid for liners of different sizes to fit in the interior chamber of the bin.

U.S. Pat. No. 8,378,597 issued to Shek describes a cover assembly comprising of two parts. The first part having an open hole and the second part having guide slots on two sidewalls and a plurality of sliding plates to open and close the hole. The purpose of this invention is to open and close access to the interior chamber of the bin and does not relate to a bin with the ability to extend and retract the top upper portion of the bin, or an adjustable bin lid for liners of different sizes to fit in the interior chamber of the bin.

U.S. Pat. No. 7,290,674 issued to Ledford describes a trash bin comprising of a plurality of lids, a divider member, and bag supporting members pivotally connected to the trash bin. The bottom of the bag supporting members engageable with the top edge portions of a trash bag when the bag supporting member is lowered on to the trash bin to secure the trash bag. The purpose of this invention is to secure a trash bag inserted into a trash bin and does not relate to a bin with the ability to extend and retract the top upper portion of the bin, or an adjustable bin lid for liners of different sizes to fit in the interior chamber of the bin.

None of the above inventions relates to a bin with the ability to extend and retract the top upper portion of the bin or an adjustable bin lid for liners of different sizes to fit in the interior chamber of the bin.

It is further an objective and feature to provide a bin with a vertical movable floor plate. Bins for disposal of trash and collection of recycled material typically involve the use of a liner. These liners come in various lengths to be inserted into the interior chamber of the bin. However, as trash and other material are disposed into the liner and bin, the liner is usually pulled towards the bottom of the bin, especially in situations where the length of the liner is not long enough to be supported by the bottom floor of the bin:

U.S. Patent Applications No. 20130037547 and 20130036924 issued to Ko describes a trashcan having an upper cover with a stepping part that moves down to compress the contents of a trashcan, and a restoring assembly comprising of an elastic element, a transmission element and a pulley to restore the stepping part to the to the upper cover. The purpose of this invention is to compress contents of a trashcan and does not provide a floor plate for supporting a liner inserted in the interior chamber of a bin.

U.S. Patent Application No. 20020056377 issued to Gawlet et al describes a refuse waste compactor having a compression member to compress refuse within a receptacle. The receptacle comprising of a sensor within the receptacle to gauge the level of refuse within the receptacle. The purpose of this invention is to compress contents of a trashcan and does not provide a floor plate for supporting a liner inserted in the interior chamber of a bin.

U.S. Pat. No. 5,645,187 issued to Brown describes a self-ejecting garbage receptacle having a tray within the receptacle moving between a first lowered position and a second raised position by a belt coupled to said tray and coil springs for ejecting said tray. Although this invention comprises of a raised tray within a garbage receptacle, it comprises of a belt and coil springs for the purpose of ejecting garbage within a receptacle.

None of the above inventions relates to a bin that provides a vertical moving floor plate for supporting a liner inserted in the interior chamber of a bin.

BRIEF SUMMARY OF THE INVENTION

The current invention relates to an improved bin used in combination with a liner for various purposes, including but not limited to the disposal of trash and the collection of recycled material. The bin having an exterior surface, an interior surface, a body, a closed bottom end, an open top end, and an interior chamber. The bin comprising of at least a slideable top portion allowing for the top opening of the bin to be adjusted in periphery thereby enabling liners of various sizes to be secured in the interior chamber of the bin.

In addition, a bin comprising of an adjustable bin lid member within a bin lid enabling liners of various sizes to be secured in the interior chamber of the bin.

Furthermore, a bin comprising of a vertical moving floor plate within the interior chamber of the bin for supporting liners of various lengths.

DETAILED DESCRIPTION OF THE EMBODIMENTS OF THE INVENTION

Figure 1:
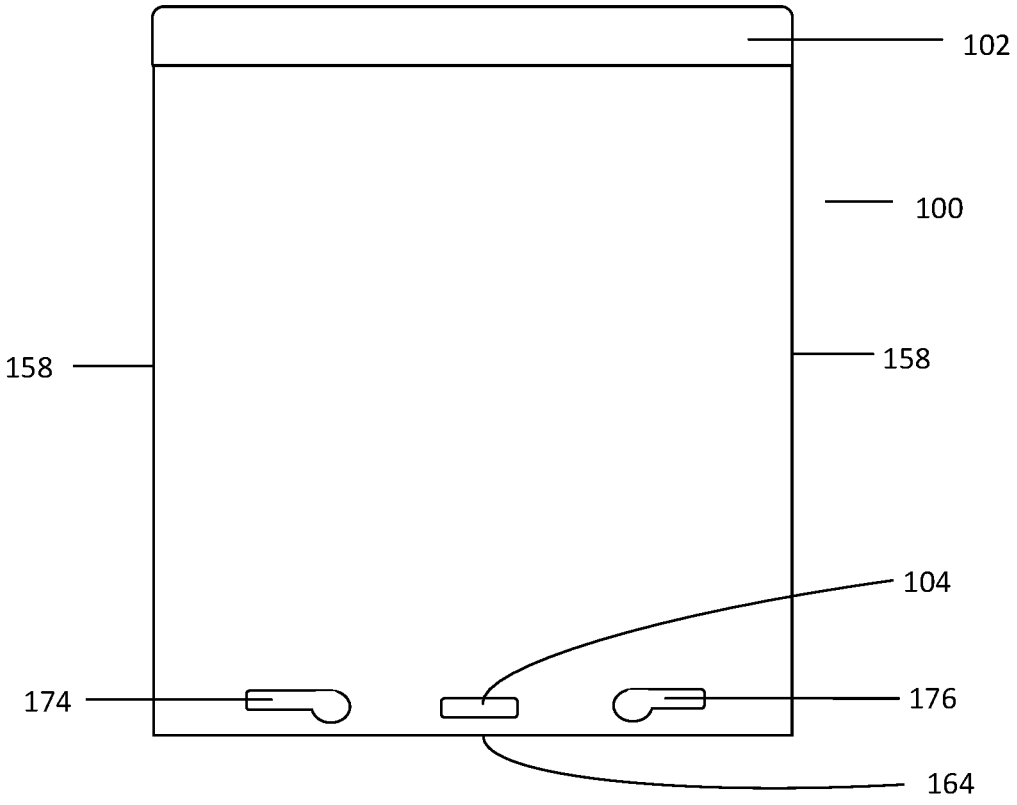
FIG. 1 is a front view of a bin.

Referring to FIG. 1, there is shown a front view of a bin 100. The bin 100 having surrounding wall 158 and a closed bottom end 164 configured to create a base with an interior chamber. A lid 102 is connected to the top of the bin 100. A pedal 104 is configured for activating opening of the lid 102. Configured on bin 100 is pedal 174 and pedal 176.

Figure 2:
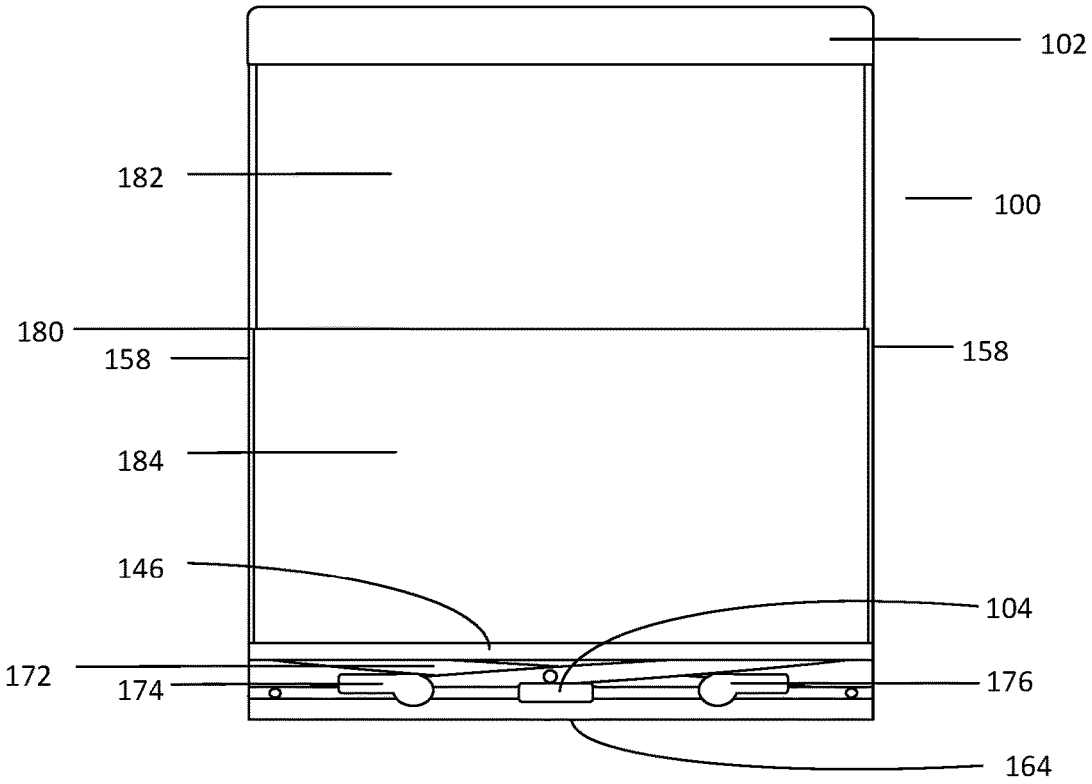
FIG. 2 is a transparent front view of the bin of FIG. 1.

Referring to FIG. 2, there is shown a transparent front view of the bin 100 of FIG. 1. The bin having surrounding wall 158 and a closed bottom end 164 configured to create a base with an interior chamber. A lid 102 is connected to the top of the bin 100. A pedal 104 is configured for activating opening of the lid 102. Secured at the bottom of the interior chamber of the bin 100 is a vertical moving floor plate 146 coupled to a scissor mechanism 172. Configured on bin 100 is pedal 174 and pedal 176. Pedal 176 configured for activating scissor mechanism 172 to raise floor plate 146. Pedal 174 configured for activating scissor mechanism 172 to lower floor plate 146. Present in the interior chamber of bin 100 is inner telescopic bin 180 coupled to floor plate 146. Inner telescopic bin 180 comprising of inner telescopic bin member 182 and inner telescopic bin member 184.

Figure 3:
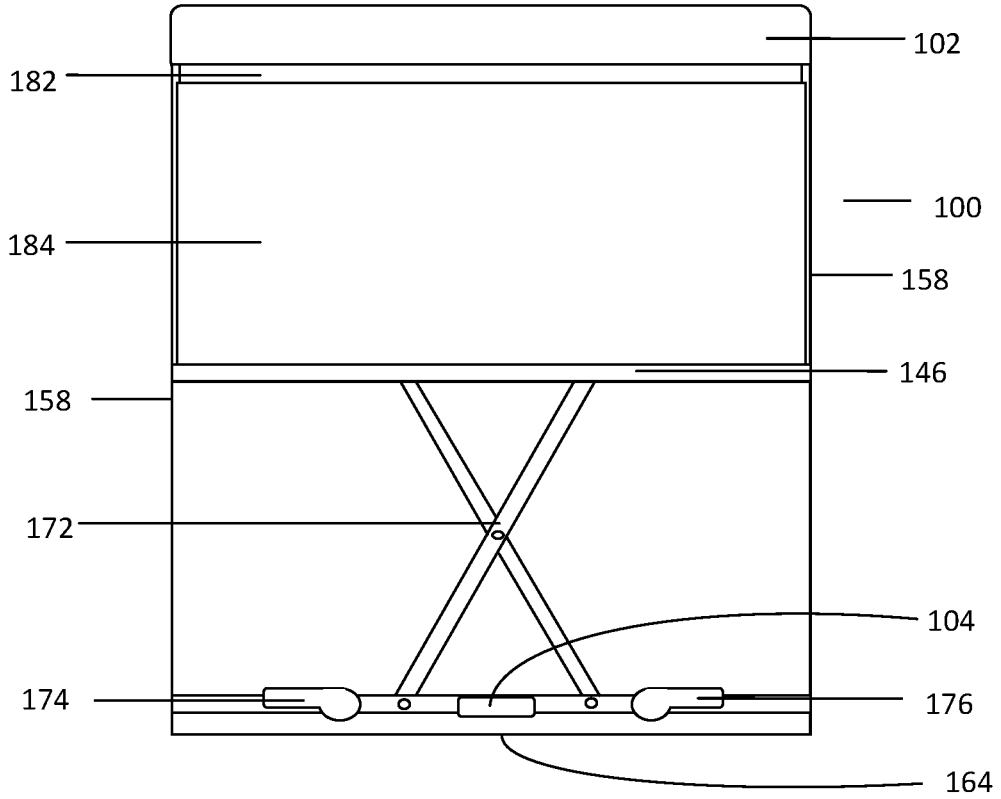
FIG. 3 is a transparent front view of the bin of FIG. 1.

Referring to FIG. 3, there is shown a transparent front view of the bin 100 of FIG. 1. This FIG. includes all the aspects of FIG. 2 but shows scissor mechanism 172 activated and floor plate 146 raised.

Figure 4:
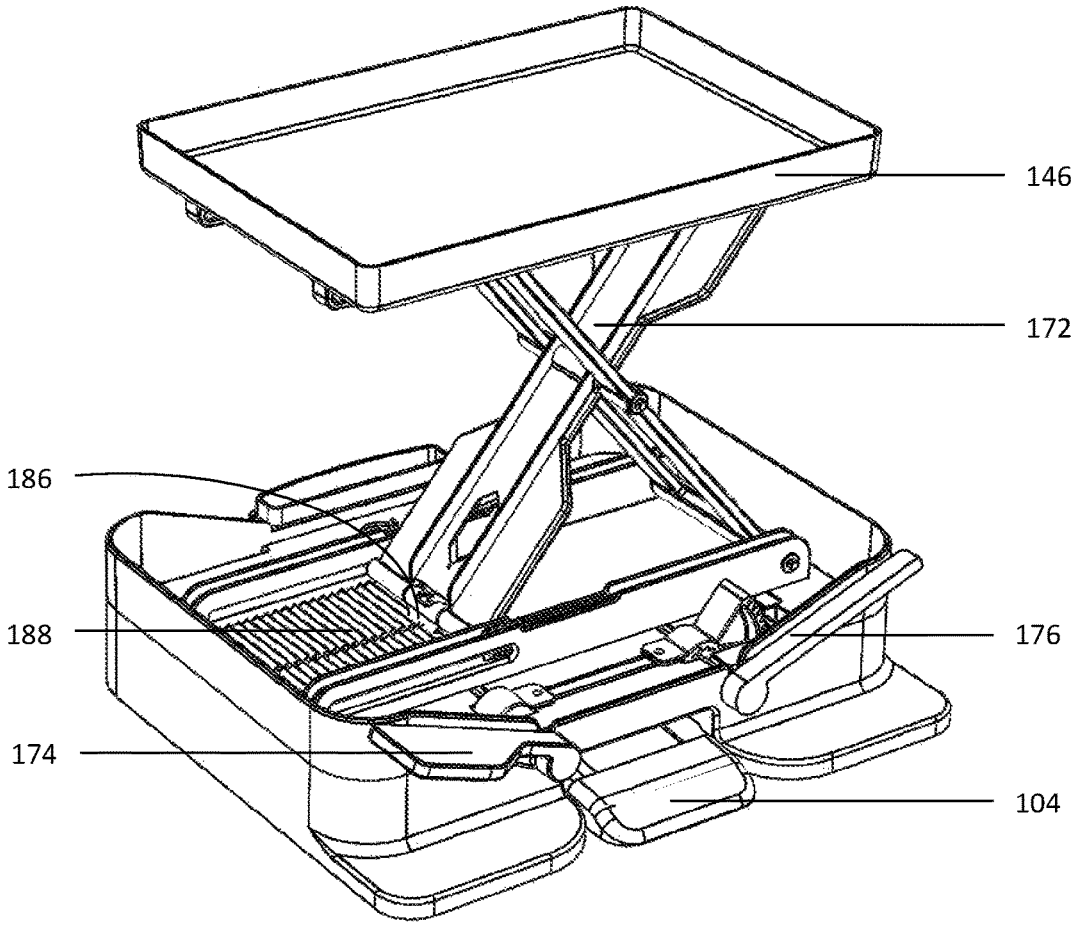
FIG. 4 is a perspective view of the scissor mechanism of the bin of FIG. 1.

Referring to FIG. 4, there is shown a perspective view of the scissor mechanism 172 of the bin 100 of FIG. 1. A pedal 104 is configured for activating opening of a lid 102. Secured in the interior chamber of the bin 100 is a vertical moving floor plate 146 coupled to a scissor mechanism 172. Configured on bin 100 is pedal 174 and pedal 176. Pedal 176 configured for activating scissor mechanism 172 to raise floor plate 146 via a linkage mechanism 186 engaged to a linear ratchet detail 188, thereby securing scissor mechanism 172 and floor plate 146 at incremental assigned heights. Pedal 174 configured for activating scissor mechanism 172 to lower floor plate 146 via disengagement of linkage mechanism 186 from linear ratchet detail 188.

Figure 5:
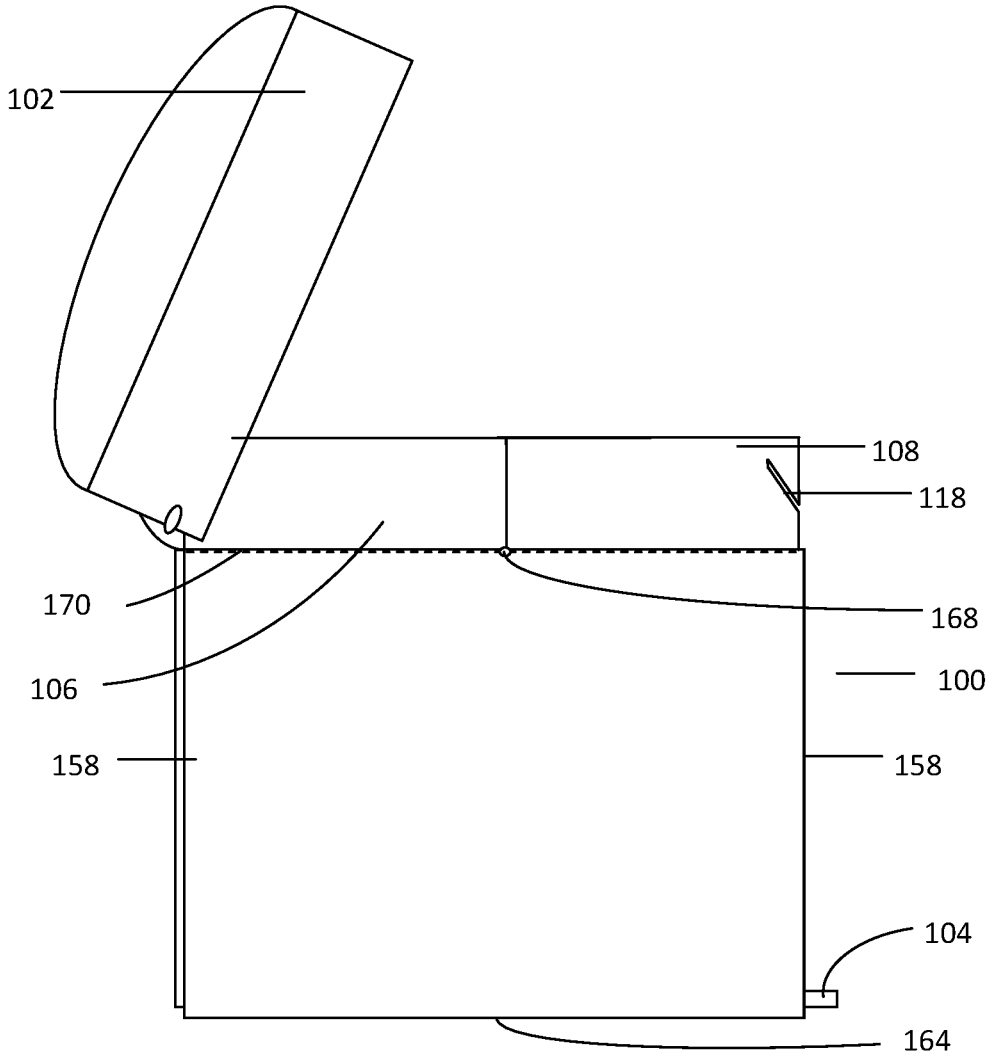
FIG. 5 is a side view of a bin.

Referring to FIG. 5, there is shown a side view of a bin 100. The bin having surrounding wall 158 and a closed bottom end 164 configured to create a base with an interior chamber. A lid 102 is connected to the top of the bin 100. A pedal 104 is configured for activating opening of the lid 102. A slideable telescopic top portion of bin 100 comprising of slideable telescopic member 106 and slideable telescopic member 108 configured on the bin 100 periphery. Present on slideable telescopic member 106 and slideable telescopic member 108 is horizontal rack gear 170. Located between horizontal rack gear 170 of slideable telescopic member A 106 and slideable telescopic member 108 is pinion gear 168. Configured on slideable telescopic member 106 and slideable telescopic member 108 is a hooking mechanism 118 for receiving first and second portions of a liner with grab handles.

Figure 6:
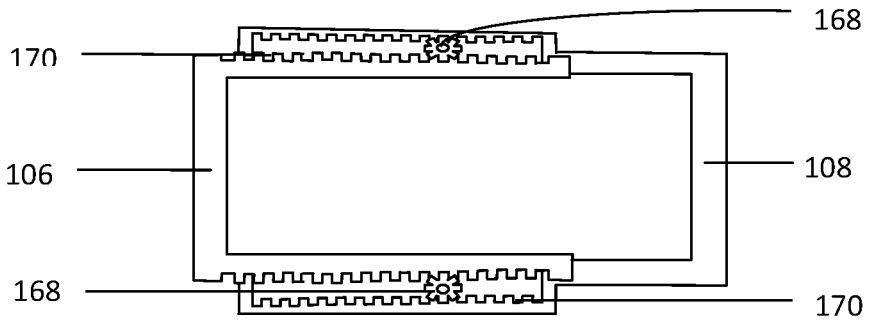
FIG. 6 is a bottom view of another embodiment of slideable telescopic members.

Referring to FIG. 6, there is shown a bottom view of slideable telescopic member 106 and slideable telescopic member 108 in a retracted position. Slideable telescopic members 106 and slideable telescopic member 108 comprising of horizontal rack gears 170. Horizontal rack gears 170 controlled by pinion gear 168.

Although the invention has been illustrated and described in the drawings and foregoing description, the same is to be considered as illustrative and not restrictive in character—it being understood that only preferred embodiments have been shown and described, and that all changes and modifications that come within the spirit of the invention as claimed are desired to be protected. Undoubtedly, many other "modifications" and "variations" on the "themes" set forth hereinabove will occur to one having ordinary skill in the art to which the present invention most nearly pertains, and such variations are intended to be within the scope of the invention, as disclosed herein. The size, shape, length, width, location and materials of the various components may vary without departing from the spirit of the invention. Many of the embodiments listed may be combined with each other to form additional embodiments of the bin and lid. The use of certain singular and plural terms like "an", "a", "it", "their", "is", "are" and similar terms while describing the present invention are to be interpreted to cover both singular and plural. The use of the term "and" while describing the present invention is to be interpreted to also cover the term "or". Furthermore, any combination of the described elements in all variations possible thereof is covered by the invention unless otherwise indicated. The terms "possessing", "having", "containing," "including," and other similar terms are to be interpreted as open-ended terms (i.e., meaning "including, but not limited to,") unless otherwise noted.

The invention claimed is:

1. A bin comprising: a surrounding wall and a closed bottom end, the surrounding wall and closed bottom end configured to create a base with an interior chamber; a top opening to the interior chamber; a floor plate secured in the interior chamber of the bin; a scissor mechanism coupled to the floor plate; at least an actuator configured to activate the scissor mechanism to move the floor plate vertically; and a linkage mechanism between the scissor mechanism and a linear ratchet detail; wherein the actuator for activating the scissor mechanism includes a first pedal for raising the floor plate and a second pedal for lowering the floor plate.

2. The bin of claim 1 comprising of an inner telescopic bin coupled to the floor plate.

3. The bin of claim 2 wherein the inner telescopic bin comprises a member A telescopically sliding vertically within a member B.

4. The bin of claim 1 comprising a lid pivotably connected to the bin, the lid being configured to pivot into open or closed positions.

5. The bin of claim 4 comprising an actuator configured for opening the lid.

6. The bin of claim 5 wherein the actuator is a pedal.

7. The bin of claim 4 comprising a dampening mechanism configured for dampening movement of the lid at least from the open position to the closed position.

8. The bin of claim 1 wherein the first pedal raises the floor plate while engaging the linkage mechanism to the linear ratchet detail.

9. The bin of claim 1 wherein the second pedal lowers the floor plate via disengagement of the linkage mechanism from the linear ratchet detail.

10. The bin of claim 1 comprising a dampening mechanism configured for dampening movement of the floor plate at least from a raised position to a lowered position.

11. The bin of claim 1 comprising a window in the surrounding wall of the bin to allow a user to see the height position of the floor plate.

* * * * *